US009568871B2

(12) United States Patent
Fukase

(10) Patent No.: US 9,568,871 B2
(45) Date of Patent: Feb. 14, 2017

(54) DUPLEX IMAGE FORMING APPARATUS WITH TWO-SIDE CONVEYANCE UNIT ROTATABLE BETWEEN OPEN AND CLOSED POSITIONS

(71) Applicant: CANON KABUSHIKI KAISHA, Tokyo (JP)

(72) Inventor: Yasuhiro Fukase, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/947,263

(22) Filed: Nov. 20, 2015

(65) Prior Publication Data

US 2016/0154348 A1 Jun. 2, 2016

(30) Foreign Application Priority Data

Nov. 28, 2014 (JP) ..... 2014-241888

(51) Int. Cl.
*G03G 15/20* (2006.01)
*G03G 15/23* (2006.01)
*G03G 21/16* (2006.01)

(52) U.S. Cl.
CPC ..... *G03G 15/234* (2013.01); *G03G 21/1647* (2013.01); *G03G 21/1685* (2013.01); *G03G 21/1695* (2013.01)

(58) Field of Classification Search
CPC ..... G03G 15/234; G03G 15/2028; G03G 2215/00586
See application file for complete search history.

(56) References Cited

U.S. PATENT DOCUMENTS 5,052,670 A * 10/1991 Makiura ..... G03G 15/234 271/127
5,280,331 A * 1/1994 Namiki ..... G03G 15/234 271/186
5,802,426 A * 9/1998 Miyazaki ..... G03G 15/2064 399/113
5,839,032 A * 11/1998 Yasui ..... G03G 15/231 271/184
5,950,050 A * 9/1999 Shirasaki ..... B65H 29/60 399/124

(Continued)

FOREIGN PATENT DOCUMENTS

JP 2007-188011 A 7/2007
JP 2009-75478 A 4/2009

*Primary Examiner* — David Bolduc
(74) *Attorney, Agent, or Firm* — Fitzpatrick, Cella, Harper & Scinto

(57) ABSTRACT

Provided is an image forming apparatus including a fixing unit that is attached to the apparatus body and includes a fixing portion configured to fix an image formed on a sheet by an image forming portion and a reverse portion configured to reverse the sheet having passed through the fixing portion, a two-side conveyance unit that includes a duplex conveyance path configured to guide the sheet reversed by the reverse portion to the image forming portion and a conveyance portion configured to convey the sheet on the duplex conveyance path, and a positioning unit configured to position the two-side conveyance unit with respect to the fixing unit. The positioning unit includes an engagement portion provided in the fixing unit, and an engagement portion provided in the two-side conveyance unit and engaging with the engagement portion of the fixing unit.

9 Claims, 9 Drawing Sheets

(56) References Cited

U.S. PATENT DOCUMENTS 6,215,970 B1 * 4/2001 Yoshikawa ..... G03G 15/234 399/124
6,882,823 B2 * 4/2005 Matsuyama ..... G03G 15/6538 399/110
6,941,094 B2 * 9/2005 Omata ..... G03G 15/1605 399/110
7,062,196 B2 * 6/2006 Nanno ..... B41J 3/60 399/107
7,136,609 B2 * 11/2006 Askren ..... G03G 21/1821 399/110
7,162,182 B2 * 1/2007 Tonges ..... G03G 21/1633 399/107
7,181,157 B2 * 2/2007 Nanno ..... G03G 15/234 399/110
7,292,805 B2 * 11/2007 Hashimoto ..... G03G 15/6529 399/124
7,382,998 B2 * 6/2008 Murrell ..... G03G 21/1638 399/107
7,587,166 B2 * 9/2009 Aono ..... G03G 15/6579 271/184
7,675,536 B2 * 3/2010 Palumbo ..... G03G 21/1638 347/108
8,032,070 B2 * 10/2011 Suzaki ..... G03G 15/234 399/320
8,087,658 B2 * 1/2012 Ohtsuki ..... B65H 5/26 271/162
2002/0102110 A1 * 8/2002 Kida ..... G03G 15/65 399/124
2002/0106224 A1 * 8/2002 Yamauchi ..... G03G 15/167 399/313
2005/0036804 A1 * 2/2005 Yokoi ..... G03G 15/0194 399/124
2005/0040583 A1 * 2/2005 Murakami ..... G03G 15/232 271/65
2006/0216060 A1 * 9/2006 Kuwata ..... G03G 15/234 399/110
2007/0253756 A1 * 11/2007 Uehara ..... G03G 15/234 399/322
2008/0279601 A1 * 11/2008 Sahara ..... B65H 29/12 399/401
2008/0317532 A1 * 12/2008 Ehara ..... G03G 15/657 399/400
2009/0035032 A1 * 2/2009 Etoh ..... G03G 15/235 399/322
2010/0034544 A1 * 2/2010 Kim ..... G03G 15/234 399/21
2010/0034559 A1 * 2/2010 Sahara ..... G03G 15/6579 399/122
2010/0098473 A1 * 4/2010 Hosoi ..... B65H 5/38 399/400
2011/0222944 A1 * 9/2011 Tanaka ..... B65H 5/062 399/407
2013/0120942 A1 * 5/2013 Ujiie ..... H05K 5/0256 361/747

* cited by examiner

DUPLEX IMAGE FORMING APPARATUS WITH TWO-SIDE CONVEYANCE UNIT ROTATABLE BETWEEN OPEN AND CLOSED POSITIONS

BACKGROUND OF THE INVENTION

Field of the Invention

This disclosure relates to an image forming apparatus that forms an image on a sheet.

Description of the Related Art

Hitherto, there have been image forming apparatuses, such as a printer, a copier, and a facsimile, which include not only a mode for forming an image on a front surface of a sheet but also a two-side printing mode for also forming an image on a rear surface of a sheet having an image formed on the front surface thereof.

In such an image forming apparatus, when the two-side printing mode is selected, a sheet having an image formed on the front surface thereof is reversed and is conveyed to a duplex conveyance path, and the sheet is conveyed again to an image forming portion so that an image is formed on the rear surface thereof.

Hitherto, JP-A-2009-75478 has proposed an image forming apparatus in which a two-side conveyance unit is provided in an apparatus body so as to be able to be opened and closed, one side of a guide member constituting a duplex conveyance path is formed in the apparatus body, the other side thereof is formed in the two-side conveyance unit, and a sheet jamming in the duplex conveyance path is able to be extracted by opening the two-side conveyance unit.

The image forming apparatus is configured such that a drive roller in a conveyance roller pair conveying a sheet on the duplex conveyance path is disposed at a fixing unit on the apparatus body side, and a driven roller is disposed in the two-side conveyance unit, thereby dividing the conveyance roller pair by the opening of the two-side conveyance unit.

In addition, the image forming apparatus is configured such that a positioning protruding portion provided in the fixing unit engages with a positioning member provided in the two-side conveyance unit at the time of closing the two-side conveyance unit, thereby positioning the drive roller and the driven roller.

Incidentally, in the image forming apparatus having the two-side printing mode, when a positional deviation occurs between a reverse roller pair conveying a sheet to the duplex conveyance path in accordance with the opening and closing of the two-side conveyance unit and the conveyance roller pair on the duplex conveyance path, the positional accuracy of an image formed on the rear surface of the sheet is degraded.

In the image forming apparatus disclosed in JP-A-2009-75478, the positioning protruding portion and the positioning member are provided in the vicinity of one conveyance roller pair among a plurality of conveyance roller pairs provided on the duplex conveyance path.

For this reason, a configuration is provided in which the positioning accuracy of one conveyance roller pair and the reverse roller pair becomes satisfactory, but the positioning accuracy of the other conveyance roller pairs on the duplex conveyance path and the reverse roller pair has a problem.

In addition, since a configuration is provided in which the duplex conveyance path is divided by the opening of the two-side conveyance unit, the positioning accuracy of the reverse roller pair and the duplex conveyance path also has a problem, which leads to a concern for the occurrence of a positional deviation of an image formed on the rear surface of a sheet.

SUMMARY OF THE INVENTION

According to an aspect of this disclosure, there is provided an image forming apparatus including an apparatus body, an image forming portion provided in the apparatus body and configured to form an image on a sheet, a fixing unit attached to the apparatus body, the fixing unit comprising a fixing portion configured to fix the image formed on the sheet by the image forming portion and a reverse portion configured to reverse the sheet having passed through the fixing portion, a two-side conveyance unit including with a duplex conveyance path configured to guide the sheet reversed by the reverse portion to the image forming portion, the two-side conveyance unit comprising a conveyance portion configured to convey the sheet in the duplex conveyance path, and a positioning unit configured to position the two-side conveyance unit with respect to the fixing unit. The positioning unit includes an engagement portion provided in the fixing unit, and an engagement portion provided in the two-side conveyance unit and engaging with the engagement portion of the fixing unit.

Further features of the present invention will become apparent from the following description of exemplary embodiments with reference to the attached drawings.

DESCRIPTION OF THE EMBODIMENTS

A printer 1 (image forming apparatus) according to an embodiment of this disclosure is an electrophotographic laser beam printer that forms toner images of four colors.

Figure 1:
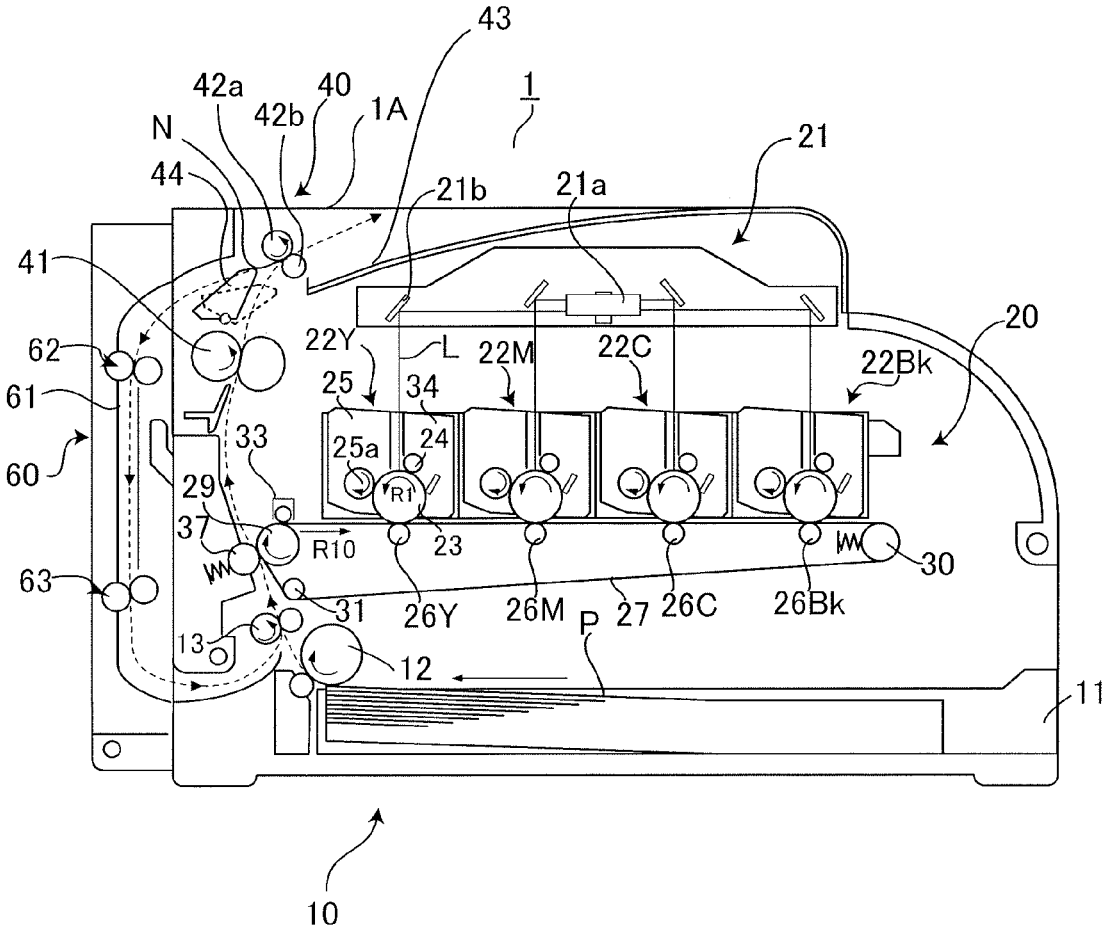
FIG. 1 is a schematic diagram illustrating the entirety of a printer according to an embodiment of this disclosure.

As illustrated in FIG. 1, the printer 1 includes a sheet feed portion 10 that feeds stacked sheets, and an image forming portion 20 that forms an image to be transferred to the sheet. In addition, the printer 1 includes a fixing unit 40 that fixes the image transferred to the sheet and discharges the sheet out of the machine, and a two-side conveyance unit 60 that is provided so as to be able to open and close with respect to an apparatus body 1A of the printer 1. It is noted that the fixing unit 40 is positioned integrally with the apparatus body 1A.

When a command to form an image is output to the printer 1, an image forming process of the image forming portion 20 is started on the basis of image information which is input from an external computer or the like connected to the printer 1. The image forming portion 20 includes an exposing unit 21, and four process cartridges 22Y, 22M, 22C, and 22Bk for forming images of four colors of yellow (Y), magenta (M), cyan (C), and black (Bk).

It is noted that the four process cartridges 22Y, 22M, 22C, and 22Bk have the same configuration except that colors of images to be formed are different from each other. Thus, only an image forming process for the process cartridge 22Y will be described, and the process cartridges 22M, 22C, and 22Bk will not be described.

The exposing unit 21 irradiates a photoconductive drum 23 of the process cartridge 22Y with a laser beam on the basis of the input image information. At this time, the photoconductive drum 23 is charged in advance by the charging roller 24, and an electrostatic latent image is formed on the photoconductive drum 23 by the irradiation with the laser beam. Thereafter, the electrostatic latent image is developed by a developing roller 25*a* of a developer 25, and a yellow (Y) toner image is formed on the photoconductive drum 23.

It is noted that, more specifically, the photoconductive drum 23 is configured by providing a photoconductive layer such as an organic photoconductor (OPC) on the outer peripheral surface of an aluminum cylinder, and rotates in a direction of R1. The charging roller 24 is constituted by a conductive resilient member that covers a cored bar and the vicinity thereof. The charging roller is disposed so as to come into contact with the surface of the photoconductive drum 23, is driven to rotate, and has a charging bias applied thereto by a power supply (not illustrated).

The exposing unit 21 includes a laser oscillator (not illustrated) that emits a laser beam L in accordance with image information, a polygon mirror 21*a*, a mirror 21*b*, and the like, and exposes the surface of the charged photoconductive drum 23 to thereby form an electrostatic latent image in accordance with image information.

Similarly, toner images of magenta (M), cyan (C), and black (Bk) are also formed on the photoconductive drums of the process cartridges 22M, 22C, and 22Bk. The toner images of the respective colors formed on the respective photoconductive drums are transferred to an intermediate transfer belt 27 by primary transfer rollers 26Y, 26M, 26C, and 26Bk, and are conveyed to a secondary transfer roller 37 by the intermediate transfer belt 27. It is noted that an image forming process for each color is performed at a timing for performing superposition on an upstream toner image which is primarily transferred onto the intermediate transfer belt 27.

The intermediate transfer belt 27 is formed in an endless shape and is bridged over a drive roller 29, a tension roller 30, and an auxiliary roller 31. The tension roller 30 has the intermediate transfer belt 27 stretched thereon, and the drive roller 29 rotates the intermediate transfer belt 27 in a direction of an arrow R10 by power transmitted from a drive unit not illustrated in the drawing.

Sheet P stacked on a cassette 11 of the sheet feed portion 10 are separated one by one by a feeding roller 12 and are conveyed toward a registration roller 13, in parallel with the above-described image forming process. It is noted that, in this embodiment, although only one stage of cassette 11 is provided, a plurality of cassettes having sheets with different sizes stacked thereon may be provided, and sheets may be fed in accordance with a sheet size selected from the plurality of cassettes.

Skew of the Sheet P is corrected by the registration roller 13, and a full-color toner image on the intermediate transfer belt 27 is transferred onto a first surface (front surface) of the sheet P, conveyed at a predetermined conveyance timing, by a secondary transfer bias applied to the secondary transfer roller 37. In the sheet P having the toner image transferred thereto, a toner is melted and firmly fixed (fixed) by predetermined heat and pressure applied in a fixer 41 (fixing portion). The sheet P having passed through the fixer 41 is discharged to a discharge tray 43 by a nip N (reverse portion) formed by a discharge reverse roller 42*a* and a driven roller 42*b*.

When an image is formed on two sides of a sheet, a switching member 44 is pivoted by a drive unit not illustrated in the drawing after the vicinity of a trailing end of the sheet P having an image formed on the first surface thereof reaches the nip N. In a state where the sheet P has been reversed upside-down and front-to-back by the discharge reverse roller 42*a* being reversely rotated by the drive unit not illustrated in the drawing, the sheet P is conveyed to a duplex conveyance path 61 formed in the two-side conveyance unit 60.

The sheet P conveyed to the duplex conveyance path 61 is conveyed to the registration roller 13 by an upper roller pair (conveyance portion) or a lower roller pair 63 (conveyance portion), thereby forming a toner image on a second surface by the secondary transfer roller 37. The toner image is fixed by the fixer 41, and the sheet P having an image formed on the first surface and the second surface thereof is discharged to the discharge tray 43 by the nip N.

On the other hand, a residual toner having not been transferred onto the sheet P is attached onto the intermediate transfer belt 27 having the toner image transferred thereto. The residual toner on the intermediate transfer belt 27 is recovered in a photoconductive drum cleaning apparatus 34 through the photoconductive drum 23 by an intermediate transfer belt cleaning unit 33. In other words, the residual toner is reversely transferred onto the photoconductive drum 23 from the intermediate transfer belt 27 by an electrode with a reverse polarity, that is, a positive polarity being applied thereto by the intermediate transfer belt cleaning unit 33.

The residual toner reversely transferred is removed by the photoconductive drum cleaning apparatus 34 together with a primary transfer residual toner on the photoconductive drum 23. It is noted that the photoconductive drum cleaning apparatus is provided not only in the process cartridge 22Y but also in the process cartridges 22M, 22C, and 22Bk, and thus a residual toner is similarly recovered therein.

Figure 2:
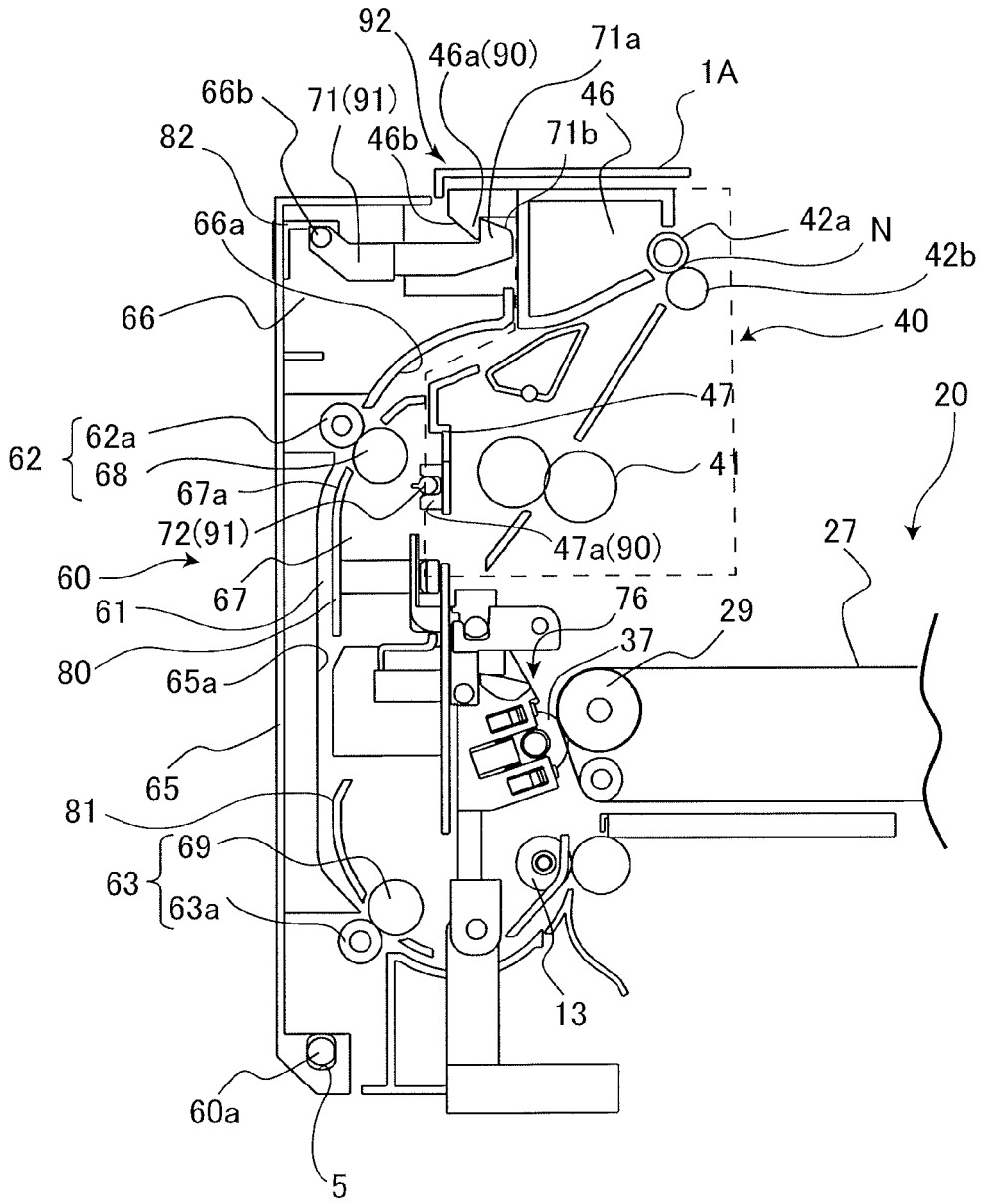
FIG. 2 is a schematic diagram illustrating a fixing unit and a two-side conveyance unit.
Figure 3:
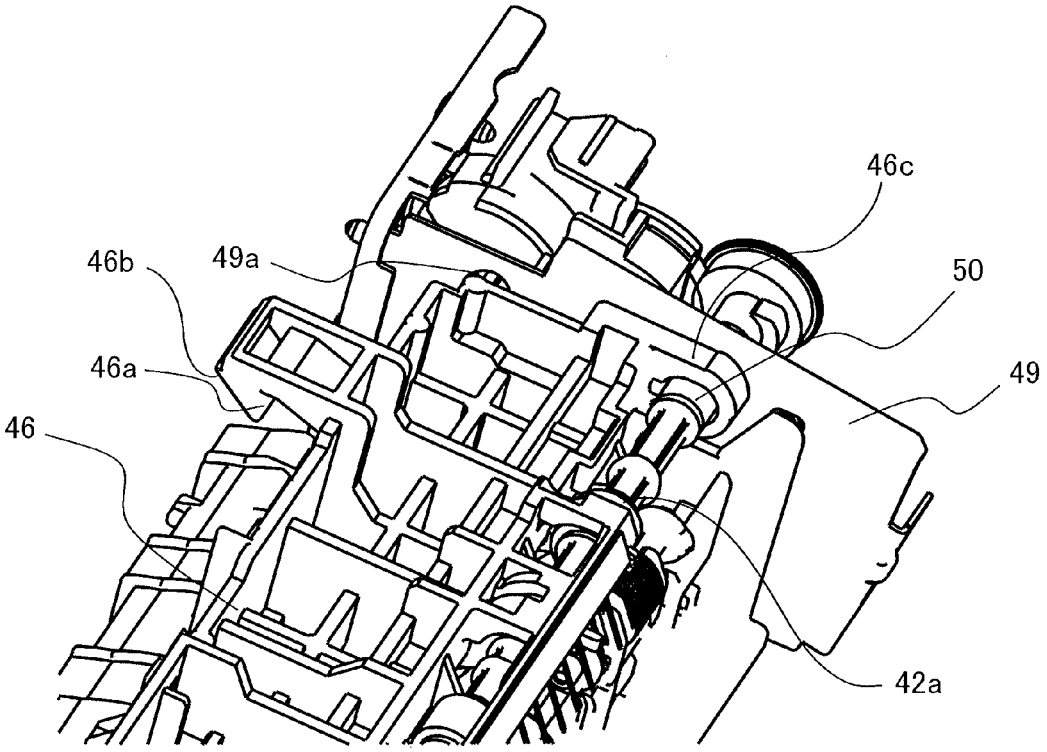
FIG. 3 is a perspective view illustrating the attachment of an upper frame to a fixing frame.
Figure 4:
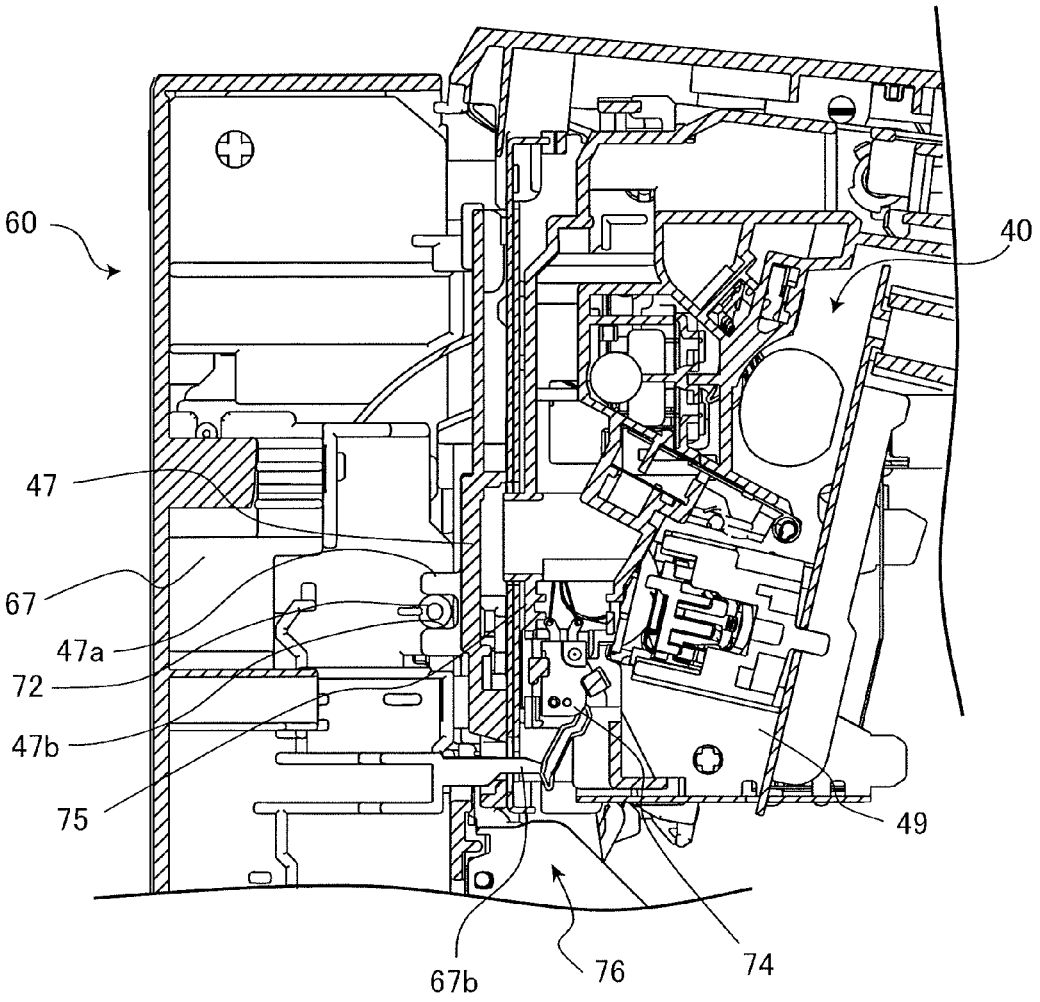
FIG. 4 is a cross-sectional view illustrating an attachment configuration of the two-side conveyance unit.

Subsequently, the fixing unit 40 and the two-side conveyance unit 60 which are main components of this disclosure will be described in detail. As illustrated in FIGS. 2 to 4, the fixing unit 40 includes a fixing frame 49 which is a frame member, an upper frame 46 which is positioned at an upper portion of the fixing frame 49, and a fixing guide 47 which is fixed on the left side of the fixing frame 49 and faces the two-side conveyance unit 60.

The fixing unit 40 is unitized by the fixing frame 49, the upper frame 46, and the fixing guide 47, and is positioned integrally with the apparatus body 1A. It is noted that the fixing unit 40 includes the fixer 41 constituted by a heating roller and a pressing roller, the discharge reverse roller 42*a*, and the driven roller 42*b*. The fixer 41, the discharge reverse roller 42*a*, and the driven roller 42*b* are rotatably supported by the fixing frame 49.

As illustrated in FIG. 3, the fixing frame 49 supports a bearing 50 of the discharge reverse roller 42*a*, and a supporting hole 49*a* is formed on the left side of the bearing 50. A shaft member (not illustrated) provided integrally with the upper frame 46 is rotatably supported by the supporting hole 49*a*, and the upper frame 46 is positioned with respect to the fixing frame 49 by an engaging portion 46*c*, provided in the upper frame 46, engaging with the bearing 50.

It is noted that the fixing frame 49 is formed so as to interpose the upper frame 46 in the width direction of a sheet, and each of the supporting hole 49*a* and the bearing 50 is actually provided at two locations in the fixing frame 49, thereby positioning the upper frame 46. In addition, the upper frame 46 may be configured to be positioned with respect to the supporting hole 49*a* by being rotatably supported centering on the bearing 50.

Claw portions 46*a* and 46*a* (first engaging members) protruding toward the two-side conveyance unit 60 are formed in both ends of the upper frame 46. The two claw portions 46*a* and 46*a* provided in the width direction of a sheet are configured to have the same shape, and have an inclined surface 46*b* which is inclined downward from the two-side conveyance unit 60 toward the upper frame 46.

As illustrated in FIG. 4, a holding bracket 75 is attached to the fixing guide 47 fixed to the fixing frame 49, and the holding bracket 75 holds a sensor 74 (detection portion) that detects the two-side conveyance unit 60 being located at a closed position. A protruding portion 47*a* (second engaging member) protrudes toward the two-side conveyance unit 60 on a surface of the fixing guide 47 on the opposite side to a surface having the holding bracket 75 attached thereto.

A notch 47*b* (concaved portion) capable of engaging with an engaging pin 72 (fourth engaging member, projecting portion) to be described later is formed in the protruding portion 47*a*. The notch 47*b* is provided below the claw portion 46*a*, and is notched substantially horizontally from the two-side conveyance unit 60 side toward the fixing unit 40. It is noted that two sets of engaging pins 72 and notches 47*b* are provided in the width direction of a sheet, but only one set will be described in this embodiment. In addition, the claw portion 46*a* and the protruding portion 47*a* constitute a fixing engagement portion 90 (engagement portion of the fixing unit, see FIG. 2).

Figure 5:
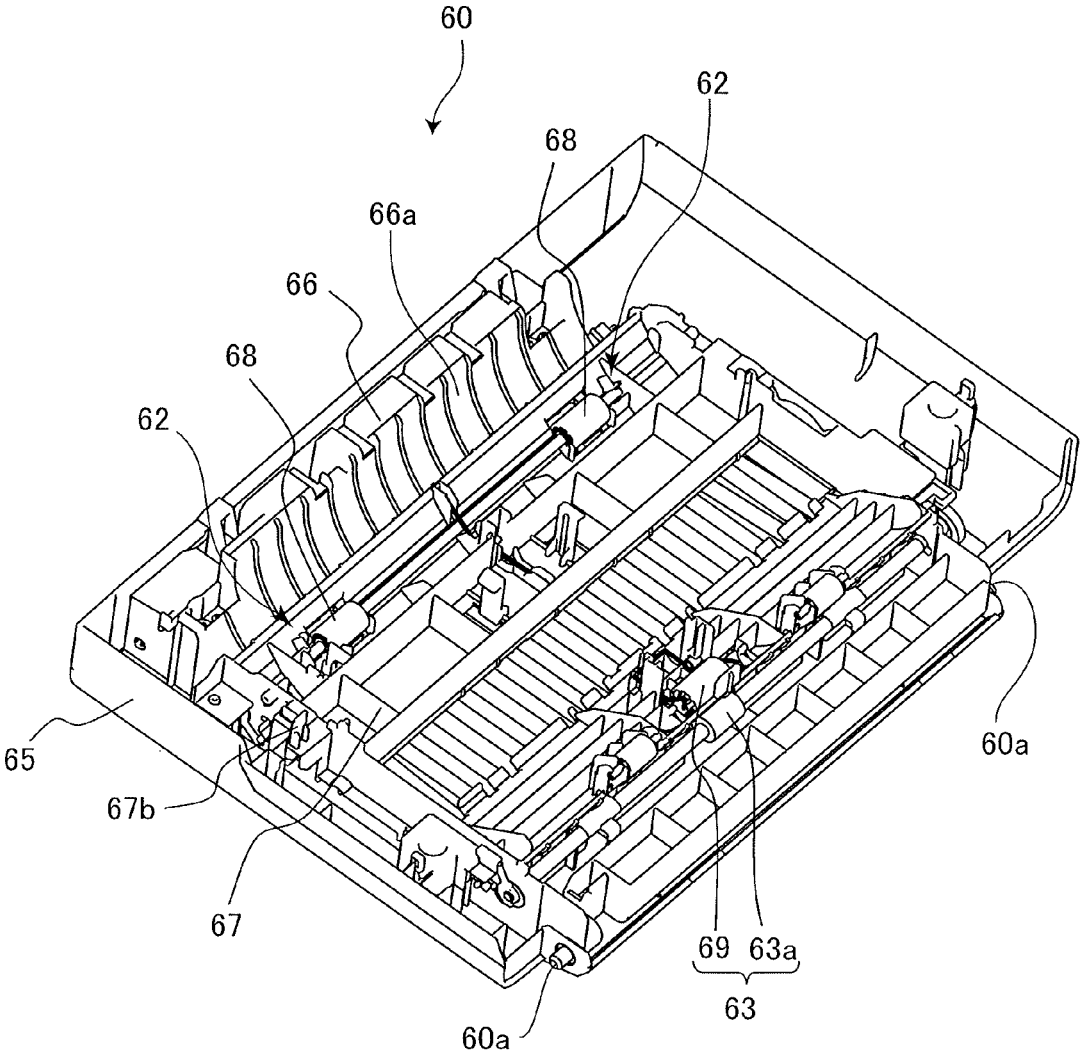
FIG. 5 is a perspective view illustrating the two-side conveyance unit.

As illustrated in FIGS. 2 and 5, the two-side conveyance unit 60 includes a two-side door 65 constituting the exterior of the printer 1, and a two-side upper guide 66 and a two-side frame 67 which are attached to the two-side door 65. Pivotal shafts 60*a* and 60*a* (pivot supporting points) protruding in the width direction of a sheet are provided in a lower portion of the two-side door 65, and the two-side conveyance unit 60 is attached to the apparatus body 1A about the pivotal shafts 60*a* and 60*a* so as to be able to pivot between an opened position and a closed position.

It is noted that the pivotal shafts 60*a* and 60*a* are fitted into an elongated hole 5 provided in the apparatus body 1A with a gap provided in a vertical direction. That is, the elongated hole 5 holds the pivotal shafts 60*a* and 60*a* of the two-side conveyance unit 60 so that the pivotal shafts are movable in a vertical direction.

An upper roller 62*a* and an upper roller 68, facing the upper roller 62*a*, which constitute the upper roller pair 62 and a lower roller 63*a* and a lower roller 69, facing the lower roller 63*a*, which constitute the lower roller pair 63 are rotatably attached to the two-side frame 67. It is noted that as illustrated in FIG. 5, two upper roller pairs 62 are provided so as to be moved away from each other at a predetermined distance in the width direction of a sheet, but only one lower roller pair 63 is provided in the center portion of the sheet in the width direction.

This is for the purpose of preventing the correction of skew of a sheet, passing through the lower roller pair 63 and conveyed to the registration roller 13, from being disturbed by the lower roller pair 63 when the skew of the sheet is corrected by the registration roller 13. Thereby, it is possible to improve the skew correction performance of the sheet.

The two-side frame 67 includes a guiding surface 65*a* and guide members 80 and 81 provided so as to be moved away from each other at a predetermined distance. The duplex conveyance path 61 is constituted by a guiding surface 66*a* formed in the two-side upper guide 66, a guiding surface 65*a* formed in the two-side frame 67, and the guide members 80 and 81. In other words, the duplex conveyance path 61 includes the guide members 80 and 81 (first guiding portion) abutting on the first surface (front surface) of a sheet, and the guiding surfaces 66*a* and 65*a* (second guiding portion) abutting on a second surface (rear surface) of the sheet.

Meanwhile, since the guide members 80 and 81 are provided so as to be separated from each other at a predetermined distance, it is possible to put one's hand between the members separated away from each other at the predetermined distance when the two-side conveyance unit 60 is located at the opened position and to improve jam processing performance.

As illustrated in FIG. 2, the two-side upper guide 66 rotatably supports two hook members 71 and 71 (third engaging members) about a pivotal shaft 66*b*. The two hook members 71 and 71 provided in the width direction of a sheet are configured to have the same shape, and include hook portions 71*a* and 71*a*, capable of engaging with the claw portions 46*a* and 46*a* provided in the upper frame 46, and inclined surfaces 71*b* and 71*b*. The inclined surface 71*b* is formed at the tip of the hook portion 71*a*, and is formed to be inclined downward from the two-side conveyance unit 60 toward the upper frame 46. The two hook members 71 and 71 are provided so as to rotate downward by a gripping portion 82, provided in the two-side door 65, being operated by a user. It is noted that the gripping portion 82 is biased by a spring not illustrated in the drawing so that the hook portions 71*a* and 71*a* rotate upward.

In addition, as illustrated in FIG. 2, the hook member 71 and the engaging pin 72 constitute a two-side engagement portion (engagement portion of the two-side conveyance unit) which engages with the fixing engagement portion 90. The two-side engagement portion 91 and the fixing engagement portion 90 constitute a positioning unit 92 that positions the two-side conveyance unit 60 in the fixing unit 40.

In addition, as illustrated in FIG. 4, the two-side frame is provided with a flag portion 67*b*. When the two-side conveyance unit 60 is located at a closed position, the sensor 74 provided in the fixing unit 40 detects the flag portion 67*b*. When the sensor 74 does not detect the flag portion 67*b*, a display unit, not illustrated in the drawing, which is constituted by, for example, a liquid crystal panel is notified that the two-side conveyance unit 60 is located at an opened position. It is noted that in an image forming apparatus for one-side printing only which is not provided with the two-side conveyance unit 60, a flag portion is provided in a door (not illustrated) attached to a transfer unit 76 including the secondary transfer roller 37, and the opening and closing of the door is detected by the sensor 74.

Figure 6:
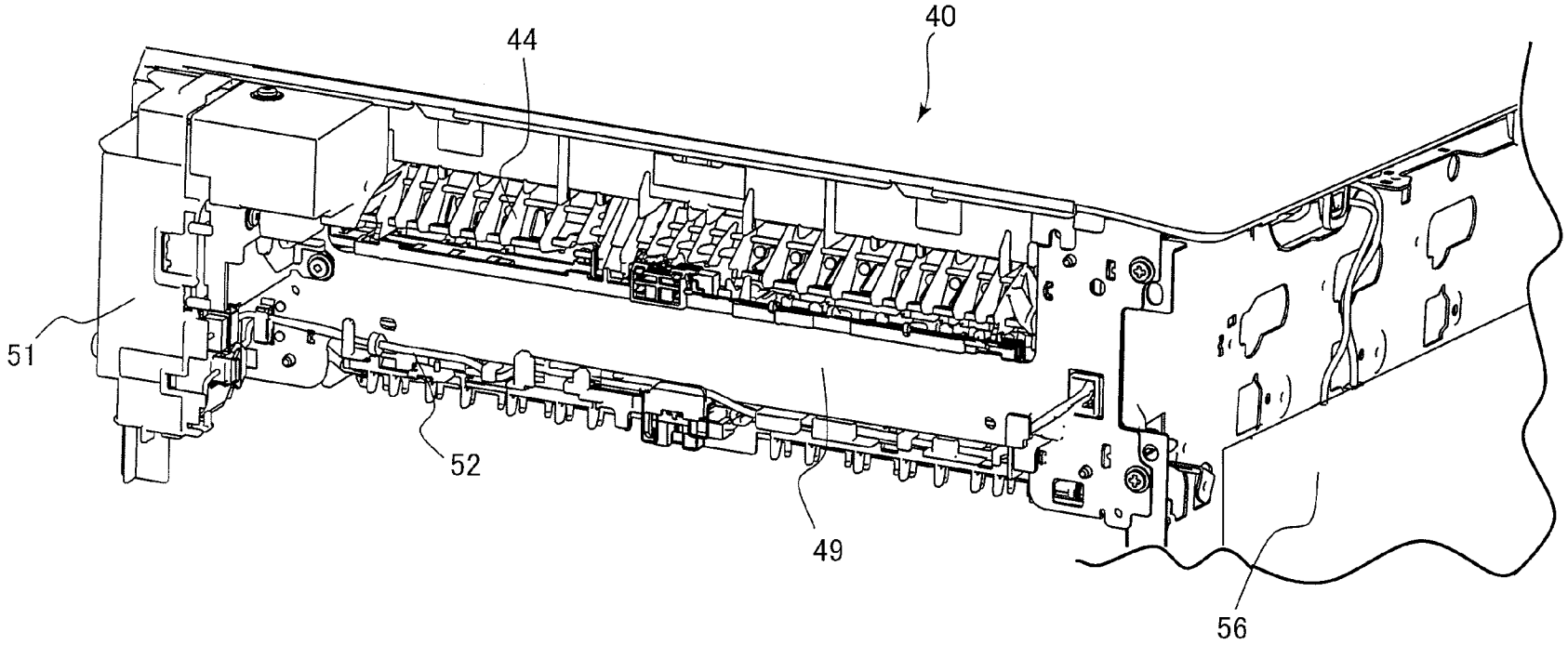
FIG. 6 is a perspective view illustrating a path of a bundle wire extending from a two-side drive unit.

In addition, as illustrated in FIG. 6, a two-side drive unit 51 having a solenoid (not illustrated) for performing a switching operation of a switching member, a solenoid (not illustrated) for reversing the discharge reverse roller 42*a*, and the like built therein is attached to an end of the fixing frame 49 in the width direction of a sheet. A bundle wire 52 extending from the two-side drive unit 51 passes in the width direction of a sheet within the fixing unit 40, and is connected to a substrate 56. In the bundle wire 52, the path thereof is selected so that the bundle wire 52 passes through, for example, the side in a vertical direction of the fixer 41 which is located lower than a heat source provided in the fixing unit 40, in order to reduce the influence of heat. Thereby, it is possible to shorten the bundle wire 52 while preventing the bundle wire 52 from being damaged due to heat, and to achieve cost reduction.

Figure 7:
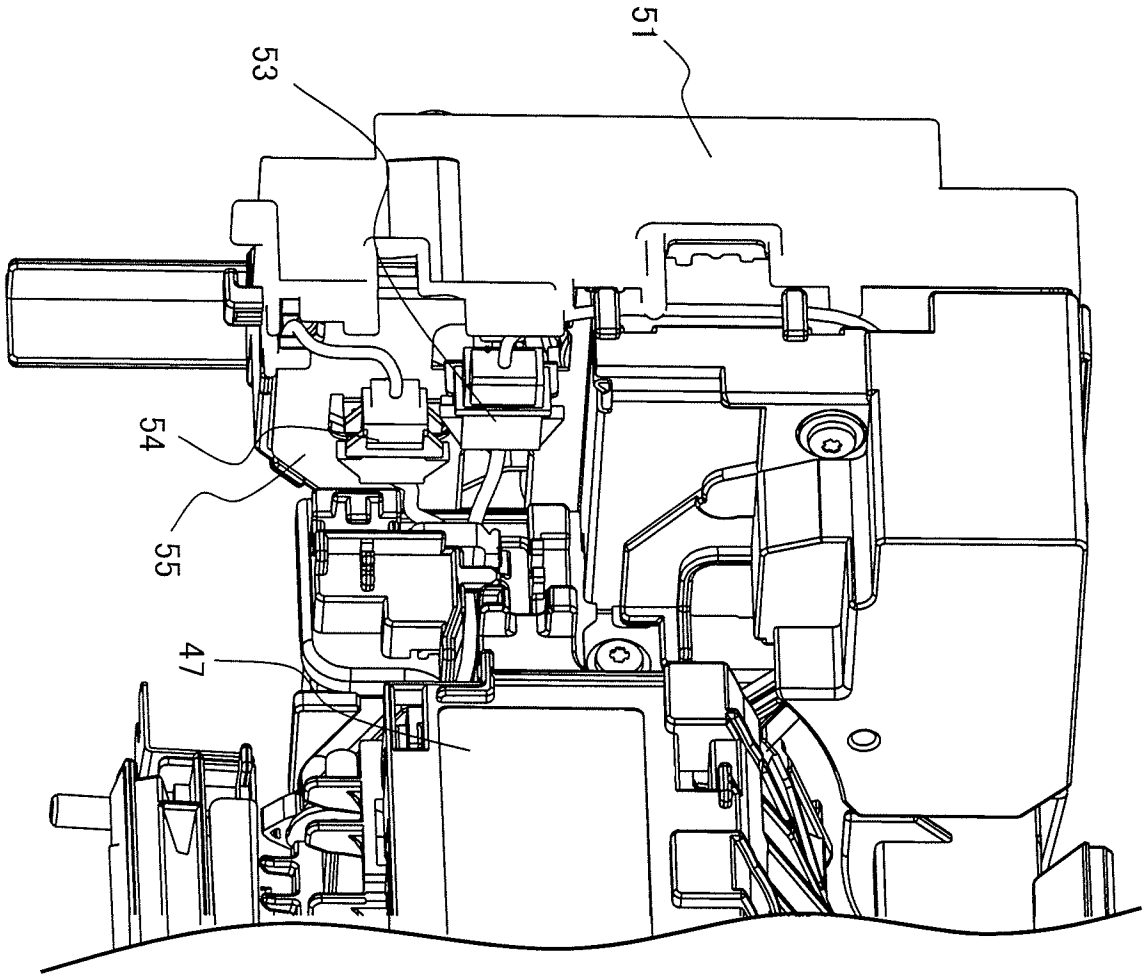
FIG. 7 is a perspective view illustrating a relay connector for connecting the bundle wire.

It is noted that, as illustrated in FIG. 7, relay connectors 53 and 54 are provided at a location where the bundle wire 52 passes from the two-side drive unit 51 to the fixing unit 40. The relay connectors 53 and 54 are held by being lightly press-fitted into a plate 55 which is bent and raised within the two-side drive unit 51. Thereby, it is possible to improve assemblability and to achieve space saving.

Subsequently, opening and closing operations of the two-side conveyance unit 60 will be described with reference to FIGS. 8 and 9. It is noted that two pairs of hook members 71 and claw portions 46*a* are provided in the width direction of a sheet so as to have the same configuration, and thus only one of the pairs will be described in a description of opening and closing operations of the two-side conveyance unit 60. In addition, two pairs of engaging pins 72 and notches 47*b* are also provided in the width direction of a sheet so as to have the same configuration, and thus only one of the pairs will be described.

Figure 8:
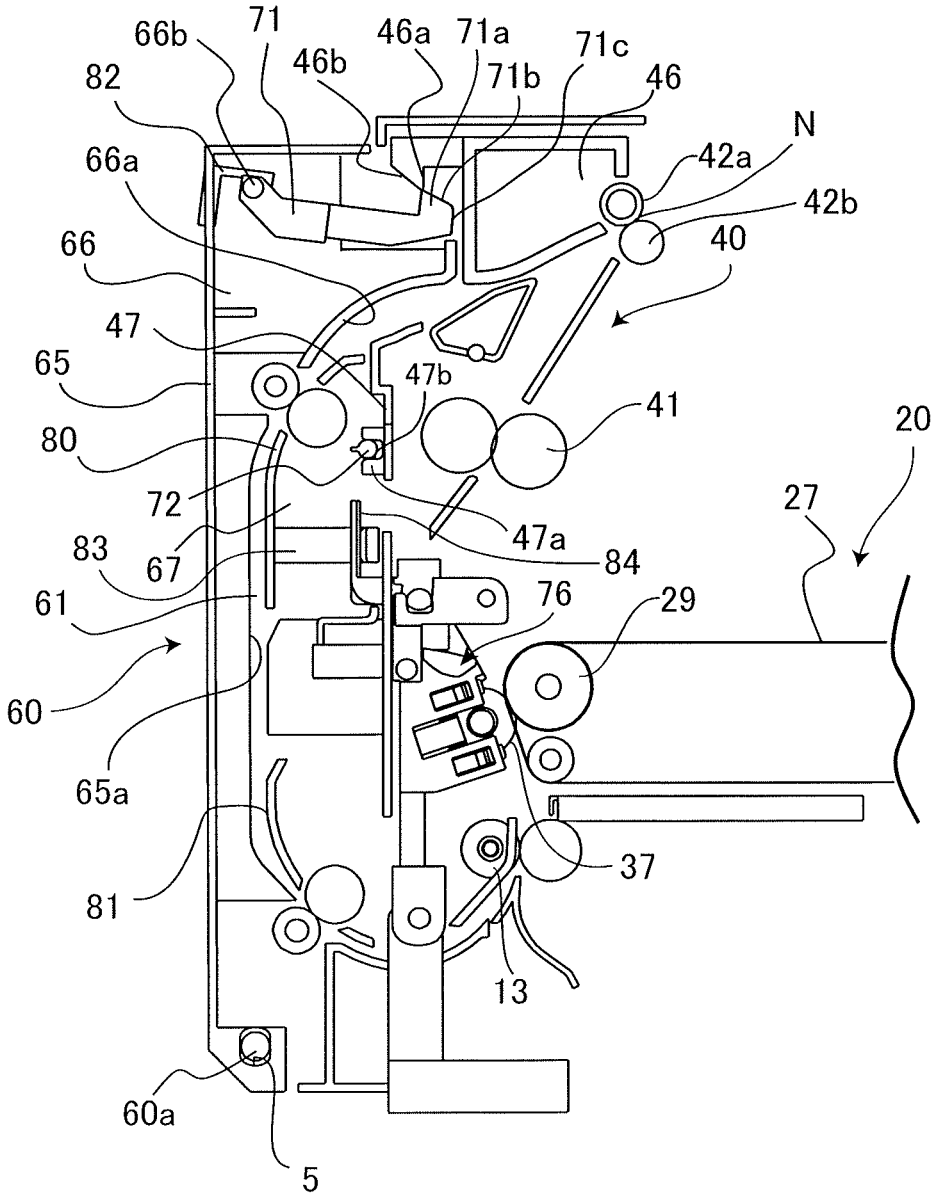
FIG. 8 is a schematic diagram illustrating an operation during the opening of the two-side conveyance unit.
Figure 9:
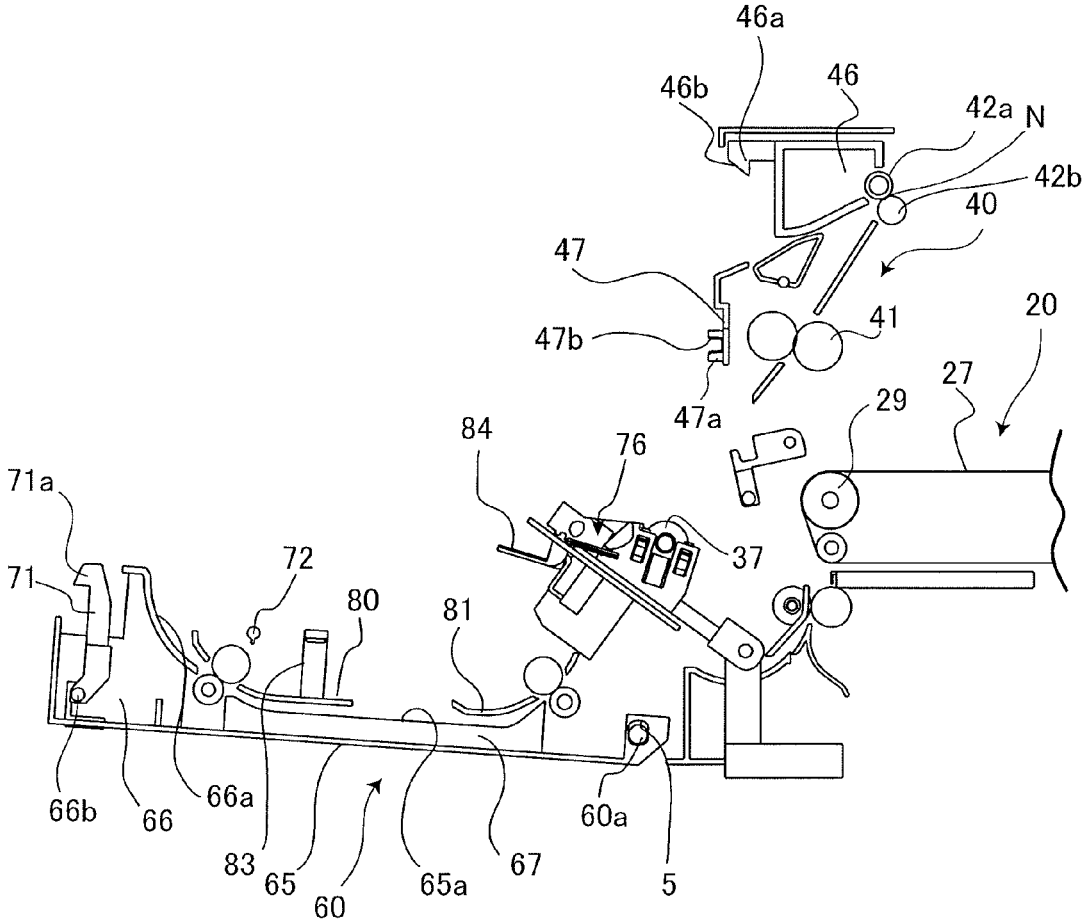
FIG. 9 is a schematic diagram illustrating the two-side conveyance unit located at an opened position.

When the gripping portion 82 is operated by a user, the hook member 71 pivots clockwise, and the hook portion 71*a* moves downward as illustrated in FIG. 8. Then, the hook portion 71*a* is set to be in a state of not engaging with the claw portion 46*a*, thereby allowing the two-side conveyance unit 60 to be opened. An opened position where the two-side conveyance unit 60 is fully opened is illustrated in FIG. 9. In a state where the two-side conveyance unit 60 is located at the opened position, the sensor 74 cannot detect the flag portion 67*b* (see FIG. 4), and thus the display unit not illustrated in the drawing is notified that the two-side conveyance unit 60 is located at the opened position.

Meanwhile, when the two-side conveyance unit 60 is being opened, an unlocking member 83 provided in the two-side frame 67 pivots a locking member 84 provided in the transfer unit 76, thereby unlocking the transfer unit 76. Thereby, when the two-side conveyance unit 60 is opened, the transfer unit 76 is also opened with respect to the apparatus body 1A, and thus it is possible to improve jam processing performance.

When the two-side conveyance unit 60 is being closed, a user brings the two-side conveyance unit 60, located at the opened position, close to the apparatus body 1A by pushing the two-side door 65. Then, the inclined surface 71*b* of the hook member 71 abuts on the inclined surface 46*b* of the claw portion 46*a*. When the user further closes the two-side conveyance unit 60, the inclined surface 71*b* of the hook member 71 pivots downward while sliding on the inclined surface 46*b* of the claw portion 46*a*. At this time, the inclined surfaces 71*b* and 46*b* are respectively provided in both the hook member 71 and the claw portion 46*a*, it is possible to reduce resistance at the time of closing the two-side conveyance unit 60 and to perform a smooth operation, thereby allowing operability to be improved.

The engaging pin 72 provided in the two-side frame 67 engages with the notch 47*b* provided in the fixing guide 47 immediately before the hook portion 71*a* of the hook member 71 engages with the claw portion 46*a* (position in FIG. 8). Thereby, the two-side conveyance unit 60 is positioned in substantially a vertical direction with respect to the fixing unit 40.

When the two-side conveyance unit 60 further approaches the apparatus body 1A from the position illustrated in FIG. 8, the hook member 71 pivots upward by a spring not illustrated in the drawing, and the hook portion 71*a* and the claw portion 46*a* engage with each other. Thereby, the two-side conveyance unit 60 is positioned in substantially a horizontal direction with respect to the fixing unit 40 and is held at a closed position.

When the two-side conveyance unit 60 is located at the closed position, the centroid of the two-side conveyance unit 60 is located on a side farther from the apparatus body 1A than the pivotal shaft 60*a*, and thus the two-side conveyance unit 60 is biased toward an opened position. The self-weight of the two-side conveyance unit 60 acts on an engagement portion between the hook member 71 and the claw portion 46*a*, and thus the two-side conveyance unit 60 is configured such that the movement thereof toward the opened position is restricted and is reliably held at the closed position. In addition, the two-side conveyance unit 60 does not excessively approach the fixing unit 40 and the apparatus body 1A more than necessary by a tip face 71*c* of the hook member 71 which abuts on the upper frame 46.

It is noted that the pivotal shafts 60*a* and 60*a* of the two-side conveyance unit 60 are fitted into the elongated hole 5 provided in the apparatus body 1A with a gap provided in a vertical direction, and thus it is possible to rotate the two-side conveyance unit 60 even after the two-side conveyance unit 60 is positioned in the vertical direction by the engaging pin 72 and the notch 47*b*.

As described above, the two-side conveyance unit 60 is positioned in substantially a vertical direction and substantially a horizontal direction with respect to the fixing unit 40, and thus it is possible to improve the positioning accuracy of the nip N, the duplex conveyance path 61, the upper roller pair 62, and the lower roller pair 63.

Specifically, component tolerance is reduced by positioning the two-side conveyance unit 60 with respect to the fixing unit 40 with a small number of components. In addition, the two-side conveyance unit 60 includes guide members and guiding surfaces which constitute the upper roller pair 62, the lower roller pair 63, and the duplex conveyance path 61, and thus it is possible to suppress a positional deviation due to the looseness of a component which occurs by a user's opening and closing operations, or the like.

It is noted that, in this embodiment, the upper roller pair 62 and the lower roller pair 63 are used as roller pairs for conveying a sheet on the duplex conveyance path 61, but the number of roller pairs may be further increased. Even in this case, a deviation of a positional relationship between a plurality of roller pairs does not occur by the opening and closing of the two-side conveyance unit 60, and thus it is possible to improve the positioning accuracy of the nip N, the duplex conveyance path 61, and the plurality of roller pairs. In addition, a sheet may be conveyed using a belt or the like instead of the roller pair.

In addition, the two-side conveyance unit 60 rotates about the pivotal shafts 60*a* and 60*a* provided in the lower portion thereof, and is positioned in a substantially horizontal direction by the hook member 71 provided in the upper portion thereof, thereby allowing the positioning to be stably performed with little looseness. Further, the engaging pin 72 and the notch 47*b* are positioned in a substantially vertical direction below the hook member 71 by engagement therebetween, and thus it is possible to reliably position the two-side conveyance unit 60 while achieving a compact configuration.

In this manner, it is possible to improve the positional accuracy of an image transferred onto a sheet by improving the positioning accuracy of the nip N, the duplex conveyance path 61, the upper roller pair 62, and the lower roller pair 63.

It is noted that, in this embodiment, although two sets of hook members 71 and claw portions 46*a* and two sets of engaging pins 72 and notches 47*b* are provided in the width direction of a sheet, each of the sets may be provided in the center portion of the sheet in the width direction, or three or more sets may be provided. In addition, these components may be disposed anywhere.

In addition, in this embodiment, the fixing unit 40 has the nip N for reversing a sheet. However, for example, in a configuration in which another unit has the nip N instead of the fixing unit, the two-side conveyance unit 60 may be positioned with respect to the another unit. In addition, the fixing unit 40 may be detachably provided in the apparatus body 1A without being fixed to the apparatus body 1A.

In addition, the hook member 71 engages with the claw portion 46*a* in the hook portion 71*a*. In addition thereto, the hook member may be configured to engage with the upper frame 46 on the tip face 71*c*. Thereby, it is possible to further improve positioning accuracy.

In addition, this embodiment is configured such that the two-side conveyance unit 60 is able to be opened and closed with respect to the apparatus body 1A, but this disclosure can also be applied to a printer (image forming apparatus) in which the two-side conveyance unit 60 is not able to be opened and closed.

In addition, the two-side conveyance unit 60 is not limited to being a unit that rotates about the pivotal shaft 60*a*, and may be a unit sliding with respect to the apparatus body 1A or a unit provided so as to be detachable from the apparatus body.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-241888, filed Nov. 28, 2014, which is hereby incorporated by reference herein in its entirety.

What is claimed is:

1. An image forming apparatus comprising:

an apparatus body;

an image forming portion provided in the apparatus body and configured to form an image on a sheet;

a fixing unit provided in the apparatus body, the fixing unit comprising:

a fixing portion configured to fix the image on the sheet; and a reverse portion configured to reverse a conveying direction of the sheet on which the image has been fixed at the fixing portion toward the image forming portion; and a two-side conveyance unit including a duplex conveyance path configured to guide the sheet reversed by the reverse portion to the image forming portion, and a conveyance portion configured to convey the sheet in the duplex conveyance path, the two-side conveyance unit being rotatable between an opened position and a closed position with respect to the apparatus body, wherein the fixing unit includes a first portion and a second portion, the two-side conveyance unit includes a third portion that engages with the first portion so as to position the two-side conveyance unit with respect to the fixing unit in a rotating direction of the two-side conveyance unit, and a fourth portion that engages with the second portion so as to position the two-side conveyance unit with respect to the fixing unit in a vertical direction, in a state where the two-side conveyance unit is located at the closed position, and the third portion engages with the first portion after the fourth engaging member engages with the second portion in a case where the two-side conveyance unit rotates from the opened position to the closed position.

2. The image forming apparatus according to claim 1, wherein the two-side conveyance unit is configured to be rotatable about a rotating center portion, and the rotating center portion is disposed below the fixing unit.

3. The image forming apparatus according to claim 2, wherein the rotating center portion is a rotation shaft provided in the two-side conveyance unit, and the apparatus body includes an elongated hole holding the rotation shaft such that the rotation shaft is movable in the vertical direction.

4. The image forming apparatus according to claim 1, wherein the two-side conveyance unit is biased toward the opened position at the closed position, and is configured such that a movement thereof to the opened position is restricted by an engagement between the first portion and the third portion.

5. The image forming apparatus according to claim 1, wherein the first portion is disposed above the second portion.

6. The image forming apparatus according to claim 1, wherein the first portion and the third portion are hook members engaging with each other, one of the second portion and the fourth engaging member has a concaved portion, and the other one of the second portion and the fourth engaging member has a projecting portion engaging with the concaved portion.

7. The image forming apparatus according to claim 4, wherein centroid of the two-side conveyance unit is located at a position farther from the apparatus body than the rotating center portion about which the two-side conveyance unit rotates.

8. The image forming apparatus comprising:

an apparatus body;

an image forming portion provided in the apparatus body and configured to form an image on a sheet;

a fixing unit provided in the apparatus body, the fixing unit comprising:

a fixing portion configured to fix the image on the sheet, and a reverse portion configured to reverse a conveying direction of the sheet on which the image has been fixed at the fixing portion toward the image forming portion; and a two-side conveyance unit including a duplex conveyance path configured to guide the sheet reversed by the reverse portion to the image forming portion, and a conveyance portion configured to convey the sheet in the duplex conveyance path, the two-side conveyance unit being rotatable about a rotating center portion between an opened position and a closed position with respect to the apparatus body, wherein the fixing unit includes a first portion and a second portion, the two-side conveyance unit includes a third portion that engages with the first portion so as to position the two-side conveyance unit with respect to the fixing unit in a rotating direction of the two-side conveyance unit, and a fourth portion that engages with the second portion so as to position the two-side conveyance unit with respect to the fixing unit in a vertical direction, in a state where the two-side conveyance unit is located at the closed position, the rotating center portion is disposed below the fixing unit, and the two-side conveyance unit is biased toward the opened position at the closed position, and is configured such that a movement thereof to the opened position is restricted by an engagement between the first portion and the third portion.

9. The image forming apparatus according to claim 8, wherein centroid of the two-side conveyance unit is located at a position farther from the apparatus body than the rotating center portion about which the two-side conveyance unit rotates.

* * * * *